US005625342A

United States Patent [19]

Hall et al.

[11] Patent Number: 5,625,342

[45] Date of Patent: Apr. 29, 1997

[54] PLURAL-WAVELENGTH FLAME DETECTOR THAT DISCRIMINATES BETWEEN DIRECT AND REFLECTED RADIATION

[75] Inventors: Gregory H. Hall, Rockledge, Fla.; Heidi L. Barnes, Covington, La.; Pedro J. Medelius, Merritt Island; Howard J. Simpson, Melbourne, both of Fla.; Harvey S. Smith, Bay St. Louis, Miss.

[73] Assignee: The United States of America as represented by the Administrator of the National Aeronautics and Space Administration, Washington, D.C.

[21] Appl. No.: 561,202

[22] Filed: Nov. 6, 1995

[51] Int. Cl.[6] ..... G08B 17/12

[52] U.S. Cl. ..... 340/578; 340/577; 250/339.05; 250/339.15; 250/340; 250/372

[58] Field of Search ..... 340/577, 578, 340/600; 137/65; 431/13; 250/554, 336.1, 339.01, 339.02, 339.05, 339.08, 339.15, 340, 372

[56] References Cited

U.S. PATENT DOCUMENTS

| | | | |
|---|---|---|---|
| 3,609,364 | 9/1971 | Paine | 250/372 |
| 3,665,440 | 5/1972 | McMenamin | 340/578 |
| 3,824,391 | 7/1974 | Noltingle et al. | 340/578 |
| 3,940,753 | 2/1976 | Müller | 340/578 |
| 4,455,487 | 6/1984 | Wendt | 250/339.05 |
| 4,533,834 | 8/1985 | McCormack | 250/554 |
| 4,639,598 | 1/1987 | Kern et al. | 250/339.15 |
| 4,709,155 | 11/1987 | Yamaguchi et al. | 250/554 |
| 4,983,853 | 1/1991 | Davall et al. | 250/554 |
| 5,311,167 | 5/1994 | Plimpton et al. | 340/578 |
| 5,339,070 | 8/1994 | Yalowitz et al. | 340/578 |

*Primary Examiner*—Jeffery Hofsass
*Assistant Examiner*—Benjamin C. Lee
*Attorney, Agent, or Firm*—William J. Sheehan; Beth A. Vrioni

[57] ABSTRACT

A flame detector employs a plurality of wavelength selective radiation detectors and a digital signal processor programmed to analyze each of the detector signals, and determine whether radiation is received directly from a small flame source that warrants generation of an alarm. The processor's algorithm employs a normalized cross-correlation analysis of the detector signals to discriminate between radiation received directly from a flame and radiation received from a reflection of a flame to insure that reflections will not trigger an alarm. In addition, the algorithm employs a Fast Fourier Transform (FFT) frequency spectrum analysis of one of the detector signals to discriminate between flames of different sizes. In a specific application, the detector incorporates two infrared (IR) detectors and one ultraviolet (UV) detector for discriminating between a directly sensed small hydrogen flame, and reflections from a large hydrogen flame. The signals generated by each of the detectors are sampled and digitized for analysis by the digital signal processor, preferably 250 times a second. A sliding time window of approximately 30 seconds of detector data is created using FIFO memories.

20 Claims, 5 Drawing Sheets

PLURAL-WAVELENGTH FLAME DETECTOR THAT DISCRIMINATES BETWEEN DIRECT AND REFLECTED RADIATION

ORIGIN OF THE INVENTION

The invention described herein was made in the performance of work under a NASA contract, and is subject to the provisions of Public Law 96-517 (94 Stat. 3019; 35 USC 200–211).

BACKGROUND OF THE INVENTION

The present invention relates in general to a method and apparatus for detecting flames which discriminates between various types of flames, and between directly received and reflected flame radiation.

Flame detectors have been in use for many years in various types of fire detection systems. For example, the Kennedy Space Center employs hundreds of ultraviolet radiation responsive flame detectors at the Space Shuttle launch pads to detect the occurrence of hydrogen fires. These are necessary because hydrogen fires generate very little visible radiation, and are thus very hard to detect with a conventional optical detector. A serious problem with radiation responsive flame detectors is their tendency to generate false alarms in response to radiation received from nonflame sources, such as a hot object or the sun for example. Numerous techniques have therefore been employed in the past to reduce the occurrence of false alarms by providing means in the detectors for discriminating between flame and nonflame radiation sources. One such technique is to make the detector responsive only to a plurality of discrete wavelengths which are present in the radiation generated by the flame to be detected, but are not present in other types of radiation. For example, a hydrogen fire emits radiation which includes both ultraviolet (UV) and infrared (IR) wavelengths and these wavelengths can thus provide a wavelength "signature" for the hydrogen flame. Another technique for reducing the occurrence of false alarms triggered by nonflame sources is to use flicker detection circuitry which monitors radiation intensity variations over time, and can thereby discriminate between a flickering flame source and a relatively constant intensity source such as the sun or a hot object, for example.

Unfortunately, even with these types of discrimination techniques, the detectors employed at the launch pads of the Kennedy Space Center continue to be prone to troublesome false alarms. In large part, these are the result of radiation received from reflections of a large flare stack flame which is continuously lit during fueling of the Space Shuttle's external hydrogen fuel tank. This flame is so large, i.e., approximately 100 feet in length, that although the flame detectors are purposely not aimed directly at the flare stack flame, the detectors will occasionally "see" the stack flame, or a reflection thereof off of a reflective surface. Since the stack flame has the same wavelength signature as any other hydrogen flame, the flame detectors cannot discriminate the flare stack flame or its reflection from any other hydrogen flame. This problem has therefore created the need for a flame detector which can discriminate both between radiation received directly from a flame, and radiation received from a reflection of a flame, as well as between radiation from a large flame and radiation from a small flame.

SUMMARY OF THE INVENTION

To satisfy the foregoing need, the present invention was developed through analysis of detected signal characteristics to discriminate between directly received flame radiation and reflected flame radiation, as well as between large and small flame radiation. The analysis indicated that when the radiation detected by both IR and UV detectors originated from the same source and was received directly by the detectors, the normalized time-domain cross-correlation of the UV and IR radiation showed waveforms with a high degree of similarity. In contrast, when the detectors were not pointing directly at the flame, but received radiation from reflections of the flame, the cross-correlation of the various detector signals showed vastly different waveforms. In the specific instance of discriminating between the Space Shuttle's large flare stack flame and the types of small flames to which the detectors are designed to respond, it was also noted that the flickering of the small flame was found to occur at a much faster frequency than that of the large flare stack flame.

Using the above two observations, the present invention was developed to analyze the radiation sensed by a plurality of wavelength specific radiation detectors, and determine whether the sensed radiation is generated by a directly sensed small flame which warrants the generation of an alarm. The heart of the invention lies in the provision of a plurality of wavelength specific radiation detectors which are selected to provide optimum discrimination among various types of radiation sources, and an algorithm which analyzes the signals generated by each of the radiation detectors. The algorithm determines first whether the radiation is received directly from a flame, and not from a reflection of a flame, and second, whether the received radiation is generated by a small flame or a large flame.

In the preferred embodiment of the present invention, a conventional digital signal processor (DSP) is programmed with the algorithm, and receives signals from three wavelength specific detectors: two IR detectors responsive to different wavelengths, and one UV detector. The three detectors are employed because the previously discussed analysis determined that each of the selected wavelengths is reflected off of a surface differently. The signals from the three detectors are digitized and then fed into the DSP which calculates the normalized cross-correlation of each pair of the signals using conventional mathematical processing. An adjustable correlation threshold is employed by the DSP to determine whether there is a high correlation between each of the signals which is indicative of radiation received directly from a single flame source. If a high correlation is not present between at least one pair of the radiation detector signals, it is an indication that the detected radiation is either received from a reflection of a single flame source, or is received from multiple radiation sources, and neither of these situations warrants generation of an alarm.

The preferred embodiment of the invention is also designed specifically to discriminate between a small hydrogen flame and the large flare stack flame that is constantly burning during Space Shuttle fueling. For this reason, the DSP also computes the frequency spectrum of the flickering in each of the detected signals by using a Fast Fourier Transform (FFT) frequency spectrum analysis of one of the detector signals which determines if the flicker frequency is relatively high and thus indicative of a small flame, or is relatively low and thus indicative of a large flame, such as the flare stack flame. This analysis can be employed with the cross-correlation analysis to insure further that the flame detector does not respond to either reflections or direct radiation from the flare stack flame. Thus, if the cross-correlation of any of the three pairs of signals exceeds the threshold, and the analysis of the flickering indicates that the source of radiation is a small flame, the DSP generates an alarm indication which can be used to activate any suitable type of alarm device.

To prevent the flickering analysis from inhibiting generation of an alarm signal when signals from both a small flame and a large flame are received, the algorithm can also perform a high pass filtering of the FFT frequency spectrum if the flicker analysis indicates the presence of reflections from a large flame. The high pass filtering removes the lower frequency large flame components from the frequency spectrum, thus leaving only high frequency components. If enough high frequency components are present to confirm the presence of a small flame, an alarm condition will also be asserted by the DSP.

In the preferred embodiment, the DSP continually receives and stores signal data from the detectors hundreds of times a second, and performs the normalized cross-correlation computation on each set of data. The FFT frequency spectrum analysis need not be performed as often, and is preferably performed once every couple of seconds. A sliding time window approximately 30 seconds in length is created using FIFO data buffers which preserves the detector data received immediately prior to and after the generation of an alarm. This arrangement permits post alarm analysis of the detector data by personnel for various purposes, such as to determine whether the flame detector is operating correctly.

BRIEF DESCRIPTION OF THE DRAWINGS

The foregoing and other features and advantages of the present invention will become apparent from the following detailed description of a preferred embodiment thereof, taken in conjunction with the accompanying drawings in which.

DETAILED DESCRIPTION OF THE PREFERRED EMBODIMENT

Figure 1:
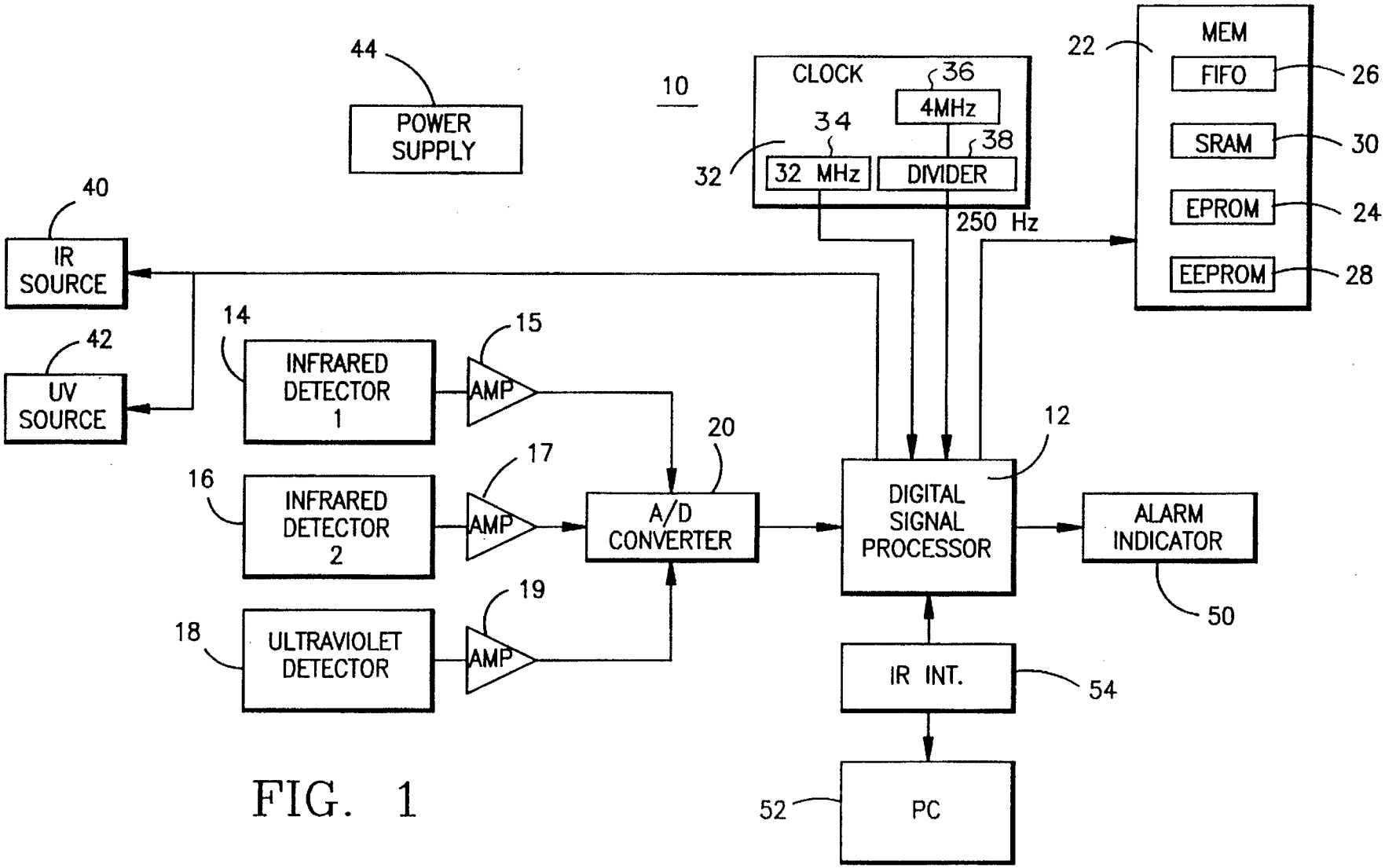
FIG. 1 is a general block diagram illustrating the circuit components employed in a flame detector comprising the preferred embodiment of the present invention.

A block diagram of the components of a flame detector 10 constructed in accordance with the preferred embodiment of the present invention is illustrated in FIG. 1. The heart of the flame detector 10 is a digital signal processor 12 (DSP) which processes signals received from first and second IR detectors 14 and 16, and a single UV detector 18. Preferably, the DSP 12 is a model number DSP56002FC40 processor, and it processes the received signals in accordance with an algorithm illustrated in FIGS. 2 and 3A–C, and discussed below.

All three of the detectors 14, 16 and 18 can be of any conventional construction, and are each responsive to radiation in a narrow band of wavelengths. The first IR detector 14 is specifically selected to be responsive to radiation of 1.3 micron wavelength, while the second IR detector 16 is selected to be responsive to radiation of 2.7 micron wavelength. The UV detector 18 is selected to be responsive to ultraviolet radiation of wavelength less than 300 nanometers and preferably in the range of approximately 180 to 260 nanometers. The wavelength sensitivities of the three detectors 14, 16 and 18 are specifically chosen so that the flame detector 10 can discriminate between directly sensed hydrogen flame radiation, and radiation received either from reflections of a hydrogen flame, or from multiple nonflame sources. All three of the wavelengths are present in all hydrogen flames, but are not present together in other types of radiation, and thus provide a hydrogen flame wavelength signature. For example, although the sun emits UV radiation, the earth's atmosphere filters out any UV below 300 nanometer wavelength, and thus, the UV detector 18 will not respond to UV from the sun. In addition, each of the detector wavelengths is reflected differently from one another so that the normalized cross-correlation of the signals received from the three detectors 14, 16 and 18 will not be high if the signals are generated by received reflections, but will be high if the signals are generated in response to a directly sensed flame.

The signals generated by each of the detectors 14, 16 and 18 are analog voltages which are fed, one each, through a respective one of first, second and third op-amp based amplifiers 15, 17 and 19. The amplified signals are then fed into a four channel A/D converter 20 that simultaneously digitizes the analog voltage signals from each of the detectors, and feeds them into the DSP 12. Preferably, the A/D converter 20 is a model number AD7874AR converter.

A plurality of memory devices indicated generally at 22 is connected to the DSP 12. These include an EPROM 24 for storing the system program; one or more FIFOs 26 for storing a moving time window of detector data; a non-volatile EEPROM 28 for permanently storing detector data upon the occurrence of an alarm; and, an SRAM 30 for temporarily storing data as it is being processed by the DSP 12. By way of example, the EPROM 24 can be implemented by a plurality of AM27C64-55LC chips; the one or more FIFOs 26 can be implemented by one or more IDT7206 chips; the EEPROM 28 can be implemented by an AM29FO10-55JC chip; and, the SRAM 30 can be implemented by an MCM56824AFN25 chip.

A clock circuit 32 controls operation of the DSP 12. The DSP 12 itself is driven by a 32 MHz clock 34. In addition, the clock circuit 32 includes a 4 MHz clock 36 which drives a divider circuit 38 to generate a 250 Hz pulse train for driving the DSP's interrupt line so that detector samples are processed once every four milliseconds as will be discussed in greater detail below in conjunctions with FIGS. 2 and 3A–C.

The DSP 12 also controls operation of an IR source 40 and a UV source 42, both of which are positioned in the field of view of each of the detectors 14, 16 and 18. These are employed during a self-testing procedure carried out by the DSP 12 to insure that each of the detectors 14, 16 and 18, as well as the DSP program, is operating properly. As will be discussed in greater detail below, the IR and UV sources 40 and 42 are caused to flicker during testing to simulate the flickering of a small hydrogen flame to which the flame detector 10 should respond with an alarm.

A power supply 44 supplies power to all of the flame detector's components, and is implemented using off the shelf voltage regulators, DC—DC converters, etc., to supply the necessary voltages for each of the components. In particular, the flame detector 10 has a+28 V input, and requires ±5 V, ±12 V 12 V and 400 V to power the various components. All of the circuit chips require +5 V, the amplifiers 15, 17 and 19 require ±12 V, the A/D converter 20 requires −5 V, and the UV detector 18 and UV source 42 both require 400 V.

The remaining components of the flame detector 10 comprise an alarm indicator 50 which can be any suitable type of visual or audible indicating device, or combination of the two, and receives alarm indication signals from the DSP 12 if it is determined that a hydrogen flame has been detected. Finally, a conventional personal computer 52 is interfaced to the DSP 12 by any suitable means, such as a serial infrared transceiver 54, and permits an operator to select the various parameters for the algorithm as discussed in greater detail below, and also to receive detector signal data, cross-correlation data and FFT data.

The flame detector 10 operates by sampling each of the detector signals 250 times per second, digitizing the sample values in the A/D converter 20, and then calculating the normalized cross-correlation values of each pair of the detector signals. It is important that the cross-correlation values be normalized to insure the accuracy of the results. In particular, if radiation is received directly from a small hydrogen flame, the normalized cross-correlation of at least one pair of the detector signals will be high, but this may not be the case if the cross-correlation computation is not normalized, especially if the magnitudes of each of the detector signals vary widely from one another. The normalization of the cross-correlation values eliminates these signal magnitude influences, so that only the shapes of the signals are compared to one another in the cross-correlation computations.

The normalized cross-correlation values are between 0 and 1.0 with 0 indicating no correlation at all between the signals, and 1.0 indicating a perfect correlation between the signals. The DSP 12 is programmed to generate an alarm anytime the normalized cross-correlation of at least one pair of the detector signals exceeds an upper threshold limit which can be selected by the user through the PC 52, and has a default setting of 0.5. Once an alarm has been generated, it will continue to be asserted until the normalized cross-correlation values for each pair of detector signals drops below a lower threshold limit that is lower than the upper limit to provide hysteresis which avoids erratic alarm operation. Again, the lower threshold limit can be set by the user, but the DSP 12 sets it by default to 0.3.

As will be discussed in greater detail below, the DSP 12 also calculates the FFT frequency spectrum for the signal received from the first IR detector 14 to determine whether the flicker frequency of the received radiation is indicative of a large or a small flame. The DSP 12 determines this by calculating the ratio of lower band energy to upper band energy in the frequency spectrum of the signal. If this ratio is below a threshold limit, e.g., 0.25, then it is determined that the flicker frequency is high enough to be indicative of a small flame, while if the ratio is above the threshold, it is indicative of a large flame. Once again, the threshold value for the ratio can be set by the operator, and includes built in hysteresis to avoid erratic alarm operation.

Figure 2:
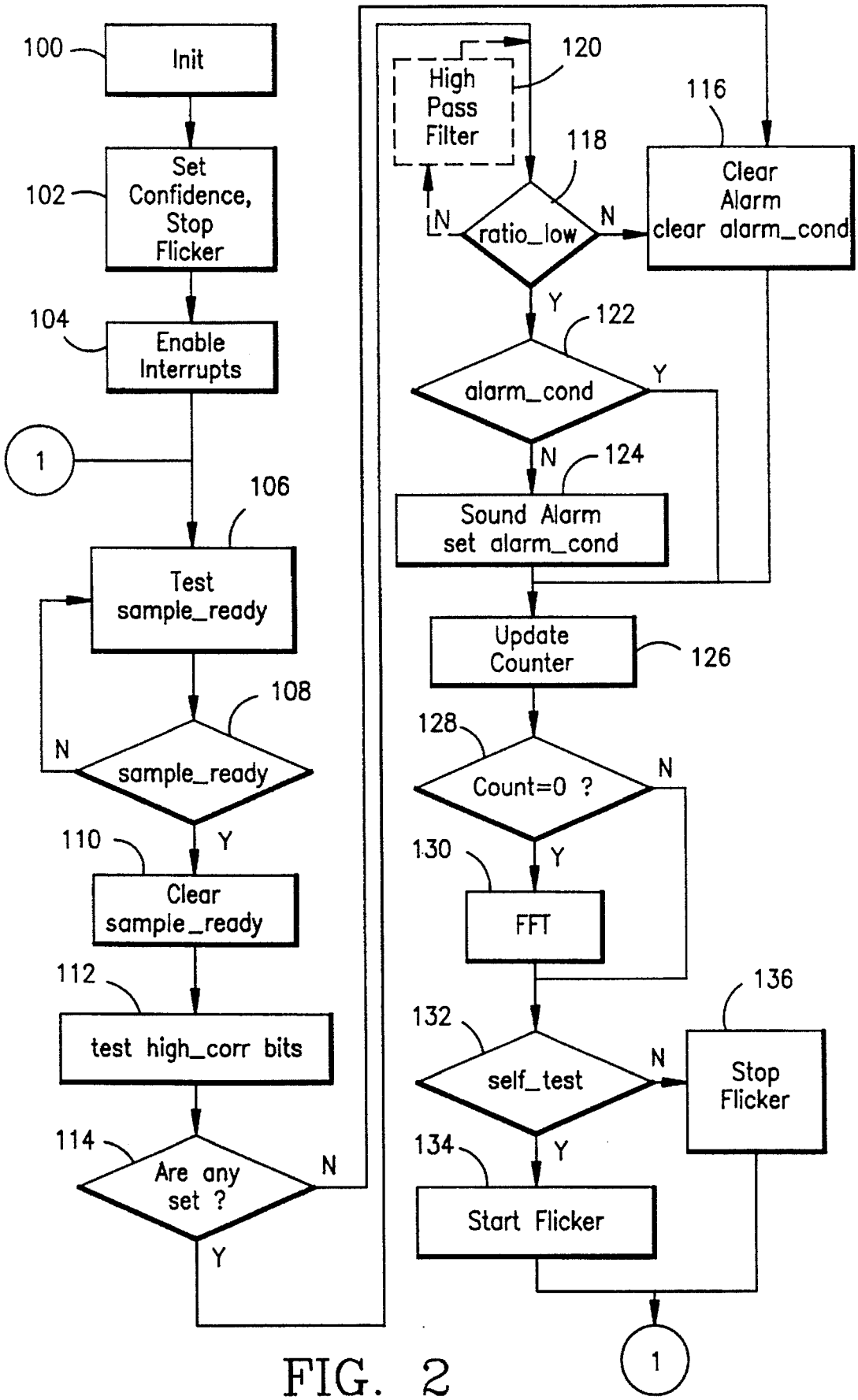
FIG. 2 is a flow chart depicting the main program of an algorithm employed by the flame detector's digital signal processor to determine whether the detector has received radiation directly from a small flame.

FIG. 2 illustrates a flow chart of the algorithm's main program which is executed by the DSP 12. The algorithm starts at step 100 by initializing the DSP's microprocessor, setting up base lines for the various calculations, etc. Next, at step 102, the DSP 12 sets a confidence relay which provides an indication to a remote monitoring unit that the system is up and ready to receive and process detector data. At the same time, the DSP 12 insures that a self test enable line entitled Flicker is not enabled. The self test function is described in greater detail below.

Figure 3A:
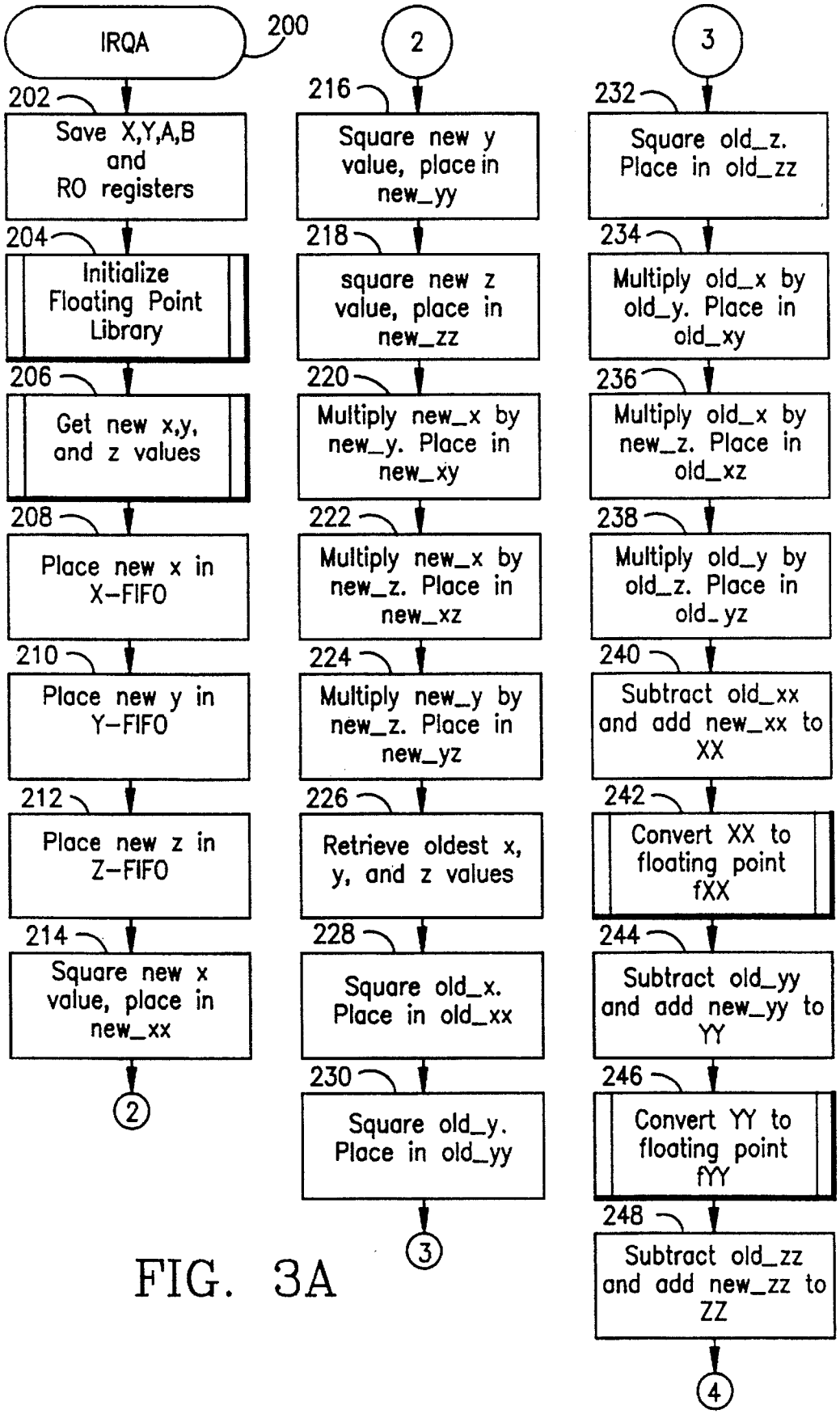
FIGS. 3A–3C are first, second and third portions of an interrupt subroutine that is called by the main program to analyze samples received from the flame detector's three radiation detectors.
Figure 3B:
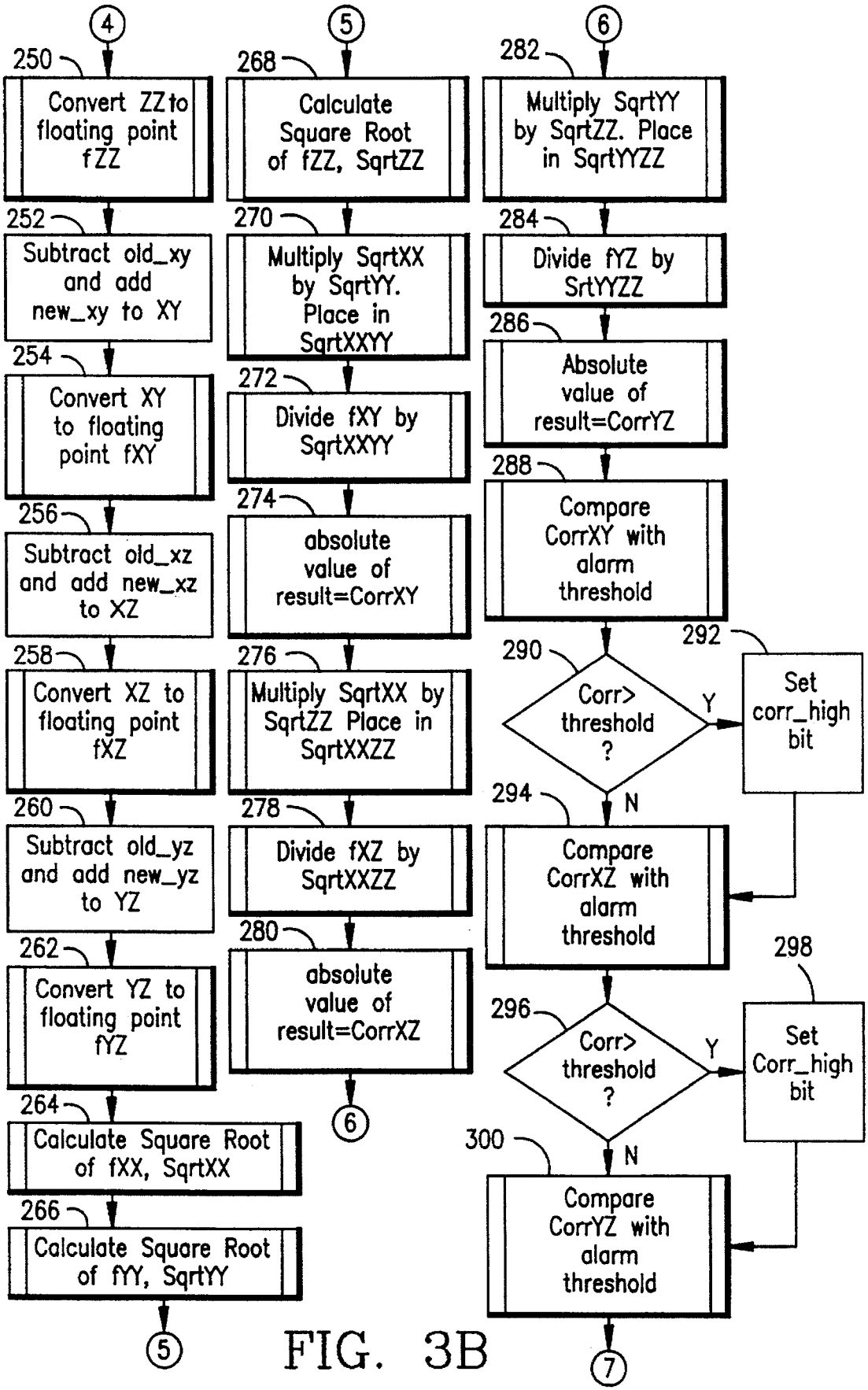
Figure 3C:
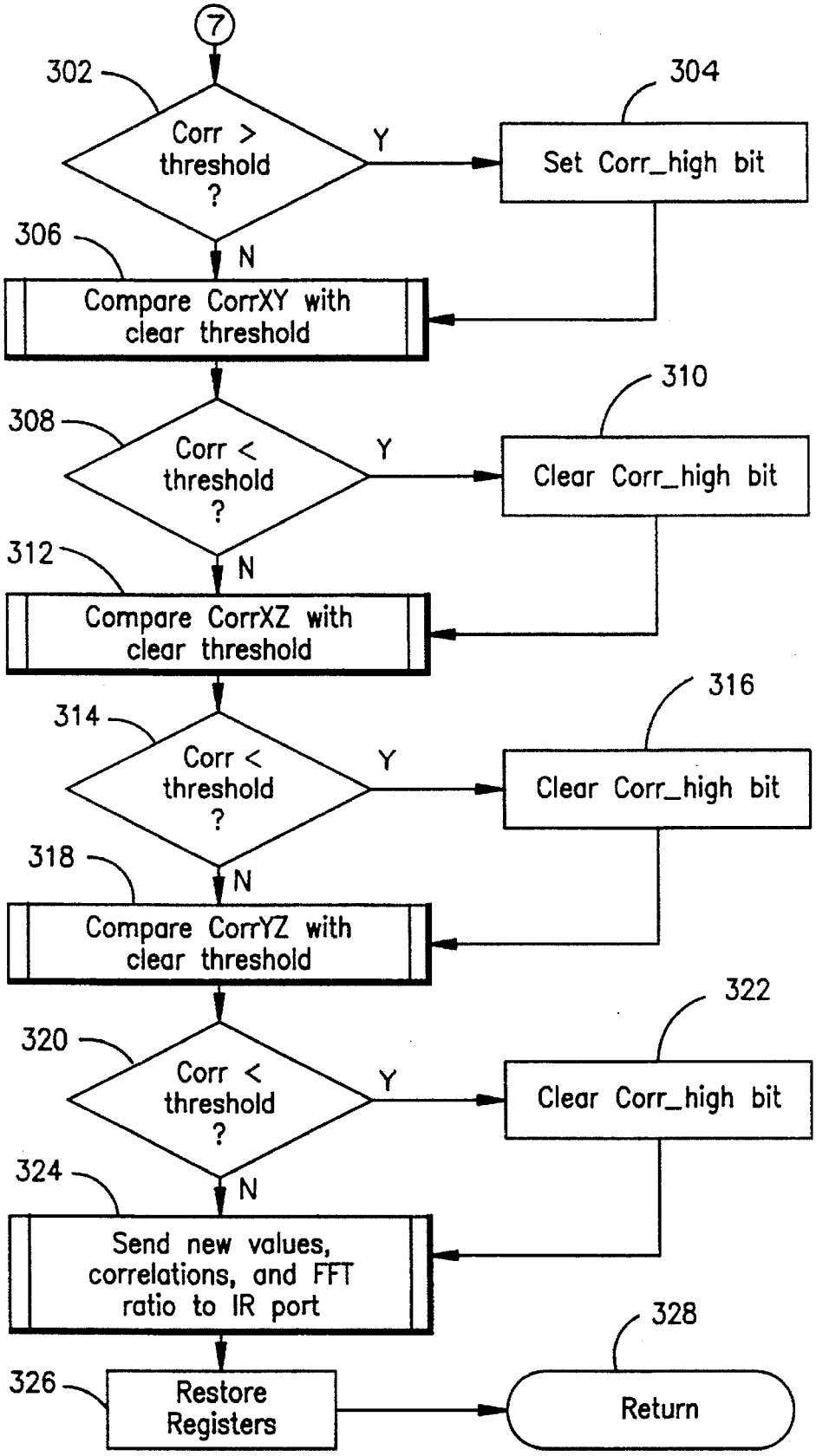

The program is now ready to begin processing detector data, so at step 104, it enables interrupts to occur which are generated every 4 milliseconds by the 250 Hz clock output from the divider circuit 38. These signal the DSP 12 to sample each of the detectors 14, 16 and 18 by commanding the A/D converter 20 to start a new conversion. When the conversion is complete, the A/D converter 20 sets its end of conversion (EOC) flag which causes the DSP 12 to read the new sample data and call the data processing subroutine. This subroutine is illustrated in FIGS. 3A–3C, and discussed in greater detail below.

Once the subroutine has been called, the main program goes to steps 106 and 108, and repeatedly inquires whether the subroutine has completed the signal sample processing, and the results are ready for testing to determine whether they indicate the presence of a small hydrogen flame which should trigger an alarm. When new signal sample correlation calculations are returned by the subroutine, a sample ready flag is set, and the program advances through steps 110, 112 and 114 to test for any high correlation bits which indicate that the cross-correlations between one or more pairs of the detector signals are above a preset threshold. The first of these three steps, step 110, is employed to clear the sample ready flag to ready the main program for the reception of the next signal sample values, while steps 112 and 114 perform the actual correlation bit tests.

If none of the correlation bits is set, this is an indication that the received detector signals are either from multiple sources, or are from a reflection, and thus do not warrant generation of an alarm condition. If this is the case, the program goes to step 116, and clears the alarm and the alarm condition flag. The program then proceeds to the FFT calculation steps discussed below.

If step 114 indicates that one or more of the correlation bits has been set high, thereby indicating at least one cross-correlation value in excess of the threshold, the program goes to step 118 to determine if the ratio of low frequency spectrum energy to high frequency spectrum energy of the first IR detector signal is low, thus indicating that the flicker frequency of the detected radiation is higher than that which would be generated by a large flame, such as the flare stack flame. If so, this is an indication that a small flame has been detected that warrants the generation of an alarm. If the ratio is above the threshold value, the program determines that the flicker frequency of the detected radiation source is too low to warrant generation of an alarm, and goes to step 116 to clear the alarm and the alarm condition flag.

Alternatively, as indicated by the dashed lines, the program can perform a high pass filtering of the frequency spectrum of the first IR detector signal at step 120 to determine if radiation from both a small flame and a large flame is being detected. The high pass filtering eliminates any low frequency components from the frequency spectrum, thus leaving only high frequency components which, if present, are indicative of a small flame. After the high pass filtering has been performed, the program once again returns to step 118 to check the low to high ratio of the filtered frequency spectrum. If it continues to be above the threshold, the clear alarm and clear alarm condition flag step 116 is executed. On the other hand, if the filtered ratio is below the threshold, this is an indication that a small flame has been detected which justifies alarm activation.

When the program determines that a flame has been detected which warrants generation of an alarm, an alarm condition flag is first checked at step 122 to determine whether an alarm condition already exists from a previous sample analysis. If it does not, the program will go to step 124, and cause an alarm to be activated (e.g., to sound), and the alarm condition flag to be set. Step 124 will be skipped if the program determines in step 122 that the alarm condition flag has already been set during a previous sample analysis.

The next steps, steps 126, 128 and 130, are carried out to perform the FFT frequency spectrum analysis of the first IR detector's signal on a periodic basis. It is unnecessary for this analysis to be performed on every sample, so the program counts through a number of samples before it will require the FFT analysis. In the preferred embodiment, the DSP 12 processes 256 samples per second but it is sufficient if the FFT analysis occurs only once every two seconds. Thus, the program employs a counter which counts down from 512 to zero over and over, and is decremented by one at step 126 each time the program processes a new group of samples. At step 128, the count of the counter is checked to see if it has reached zero. If it has, the FFT analysis is conducted at step 130. If it has not, the FFT analysis is skipped, and the program advances to its final steps.

The final steps of the program are steps 132, 134 and 136. Step 132 inquires whether the self test function of the flame detector has been implemented by an operator. This function activates the IR and UV radiation sources 40 and 42, and causes them to flicker in a manner which simulates a small hydrogen flame that should cause the flame detector 10 to generate an alarm. If the self test flag is set, the program goes to step 134 which enables the Flicker enable output that activates the IR and UV sources 40 and 42. If the self test flag is not set, the program goes to step 136 to disable the Flicker enable output and insure that it remains disabled until the self test flag is once again set. This completes one cycle of the main program flow, and the program then returns to step 106 to wait for the next detector signal samples to be ready for testing.

The detector data processing subroutine which is called by the DSP 12 once the interrupts have been enabled, and new detector sample data has been received from the A/D converter 20, is illustrated in FIGS. 3A–3C. The subroutine starts at step 200 by receiving an interrupt from the A/D converter 20 indicating that new detector signal samples are available for processing. At step 202, the subroutine performs a conventional housekeeping function by saving numerous registers, and then initializes a floating point library at step 204 so the floating point calculations can be performed even though the DSP 12 only processes integer values.

The new detector signal sample values, labelled x, y and z, are obtained from the A/D converter 20 at step 206. Before these sample values are stored, a dc offset is calculated and subtracted from each of them. The dc offset is calculated by adding the values of a plurality of previously obtained samples that are stored in memory, and then dividing by the number of samples to obtain their average. This average is the dc offset which is then subtracted from the latest sample value. Next, at steps 208, 210 and 212, the new sample values (minus the dc offset values) are placed into three individual FIFO registers contained internally in the DSP 12. In addition, the x signal sample value from the first IR detector 14 is also placed in a fourth internal FIFO register, and is employed for the FFT computation and analysis.

At the same time, each of the three detector signal sample values is also loaded into the external FIFO 26 if the FIFO 26 is not already full. During normal operation, the external FIFO 26 is maintained in a half full condition so that the last 15 seconds of sample values are always contained therein. When an alarm occurs, the DSP 12 causes the external FIFO 26 to fill completely, and then transfer its contents to the non-volatile EEPROM 28 so that the detector signal sample values for the 15 seconds before and 15 seconds after the alarm is activated are preserved for later analysis.

Each of the new x, y and z values is squared, and placed in registers labelled new_xx, new_yy and new_zz at steps 214, 216 and 218. Next, at steps 220, 222 and 224, each of the new x, y and z values are multiplied with each other to obtain xy, xz and yz, and these are placed in registers labelled new_xy, new_xz and new_yz.

The next group of steps from step 226 to step 262 is carried out to subtract old data values from accumulated value registers for each of the six variables xx, yy, zz, xy, xz and yz, and then add the new values to the accumulated value registers. These groups of accumulated values are then employed in the cross-correlation calculations so that the cross-correlations are performed on groups of samples obtained over the 30 second sliding time interval window. In steps 226-238, the oldest x, y and z sample values are retrieved out of their respective FIFOs, and are then squared and multiplied in the same manner as the new values to obtain xx, yy, zz, xy, xz and yz. At steps 240–262, each of these old values is subtracted from its respective accumulated value register XX, YY, ZZ, XY, XZ and YZ, while the new values are added to the accumulated values. The new accumulated values are then converted to floating point values.

Next, in steps 264, 266 and 268, the square roots of the floating point accumulated values of XX, YY, and ZZ are calculated. Using these values, the subroutine then calculates the normalized correlations between the x and y, the x and z, and the y and z signals in steps 270–286. In steps 270–274, the normalized correlation of the x and y signals is obtained by multiplying the square roots of XX and YY, dividing the floating point value of XY by the square root of XXYY, and then taking the absolute value of this result. Steps 276–280 perform the same function for the x and z signals, while steps 282–286 perform the same functions for the y and z signals.

The next steps of the subroutine from steps 288 to 322, are carried out to compare the three normalized correlation values with the preset alarm upper threshold value to determine whether the correlation bits should be set. Each of the three correlated values CorrXY, CorrXZ and CorrYZ has its own correlation bit which is set anytime the correlation of that value exceeds the upper threshold value. Steps 306–322 are employed to clear the correlation bits once any of the correlation values drop below the lower threshold value to enable the alarm function to be removed once the flame source which triggered the alarm no longer is detected.

The final steps of the subroutine are steps 324, 326 and 328 which send the new sample values, their correlations and the FFT ratio calculated by the main program to the IR interface serial I/O port of the DSP 12 for reception by the PC 52. Step 326 restores the various value registers, and then the subroutine returns to the main program at step 328 to wait until it is called again by the interrupt from the A/D converter 20 to receive and process the next signal samples.

In summary, through use of the multiple wavelength selective radiation detectors and the algorithm for processing the signals generated by the detectors, the flame detector is able to discriminate not only between flame and nonflame sources, but also between directly received flame radiation and reflected flame radiation. This is made possible by choosing radiation wavelength sensitivities for each of the detectors which have different reflection characteristics from one another, and then employing the normalized cross-correlation calculations to analyze each of the signals generated by the detectors. In addition, the use of the FFT frequency spectrum analysis enables the flame detector also to discriminate between large and small flames.

Although the present invention has been disclosed in terms of a preferred embodiment, and variations thereon, it will be understood that numerous other modifications and variations could be made thereto without departing from the scope of the invention as defined in the following claims. For example, although the preferred embodiment was designed specifically for detecting small hydrogen flames, it will be understood that the flame detector can also be employed for detecting other types and sizes of flames. To detect different types of flames, the wavelength selectivities of the three radiation detectors can be changed as required depending upon the wavelength signature of the type of flame to be detected. The size of the flames to which the detector is responsive can also be changed by simply modifying the frequency spectrum analysis, and the associated threshold value. Additionally, the flame detector can be made to respond to flames based upon distance from the detectors. For example, the different IR components of a hydrogen flame attenuate at different rates over distance. Using amplitude correlation calculations, this characteristic can therefore be employed to cause the flame detector to respond to close by large flames with an alarm, while rejecting all other large flame generated signals.

What is claimed is:

1. A flame detector apparatus comprising:

a) first and second radiation responsive detectors, said first radiation responsive detector being responsive to radiation of a first wavelength and said second radiation responsive detector being responsive to radiation of a second wavelength, wherein said first and second wavelengths are present in radiation from a flame to be detected, but are reflected differently off of a reflective surface, each said detector generating a signal in response to detected radiation;

b) processor means for analyzing the signals generated by said first and second detectors, and determining therefrom whether radiation detected by said first and second detectors is received directly from a flame, or is received from a reflection of a flame, said processor means including means for generating an alarm signal if it is determined that radiation detected by said first and second detectors is received directly from a flame; and c) alarm indicator means responsive to said alarm signal for indicating that a flame has been detected.

2. The flame detector apparatus of claim 1, wherein said processor means further includes memory means for storing a sliding time interval window of data corresponding to the signals generated by said first and second detectors.

3. The flame detector apparatus of claim 1, further comprising means for testing the operation of said flame detector, said means for testing being controllable by said processor means and including at least one radiation source positioned to be detectable by said first and second detectors, said radiation source generating radiation including wavelengths to which said first or second detectors is responsive.

4. The flame detector apparatus of claim 1, wherein said processor means further includes means for determining whether detected radiation is generated by a small flame or a large flame.

5. The flame detector apparatus of claim 4, wherein said means for determining whether detected radiation is generated by a small flame or a large flame further comprises means for calculating a frequency spectrum of at least one of said detector signals, and determining a ratio of low frequency energy to high frequency energy in said frequency spectrum to determine whether said at least one of said detector signals is indicative of a small flame flicker frequency or a large flame flicker frequency.

6. The flame detector apparatus of claim 5, wherein said means for determining whether detected radiation is generated by a small flame or a large flame further comprises means for high pass filtering the frequency spectrum of said at least one of said detector signals to form a filtered spectrum if the determined ratio of low frequency energy to high frequency energy is above a threshold ratio, and then determining the ratio of low frequency energy to high frequency energy of the filtered spectrum to determine whether said at least one of said detector signals is indicative of a small flame flicker frequency.

7. The flame detector apparatus of claim 1, wherein said first radiation responsive detector is responsive to radiation of a first infrared wavelength, and said second radiation responsive detector is responsive to ultraviolet wavelength radiation.

8. The flame detector apparatus of claim 7, further comprising a third radiation responsive detector, said third radiation responsive detector being responsive to radiation of a second infrared wavelength.

9. The flame detector apparatus of claim 8, wherein said first radiation responsive detector is responsive to infrared radiation of approximately 2.7 micron wavelength, said second radiation responsive detector is responsive to ultraviolet radiation of wavelengths less than 300 nanometers, and said third radiation responsive detector is responsive to infrared radiation of approximately 1.3 micron wavelength.

10. The flame detector apparatus of claim 1, wherein said processor means further includes means for calculating the normalized cross-correlation of the signals generated by said first and second radiation responsive detectors to determine whether radiation detected by said detectors is received directly from a flame, or is received from a reflection of a flame.

11. The flame detector apparatus of claim 2, wherein said processor means further includes means for determining whether detected radiation is generated by a small flame or a large flame.

12. The flame detector apparatus of claim 3, wherein said means for determining whether detected radiation is generated by a small flame or a large flame further comprises means for calculating a frequency spectrum of at least one of said detector signals, and determining a ratio of low frequency energy to high frequency energy in said frequency spectrum to determine whether said at least one of said detector signals is indicative of a small flame flicker frequency or a large flame flicker frequency.

13. The flame detector apparatus of claim 4, wherein said means for determining whether detected radiation is generated by a small flame or a large flame further comprises means for high pass filtering the frequency spectrum of said at least one of said detector signals to form a filtered spectrum if the determined ratio of low frequency energy to high frequency energy is above a threshold ratio, and then determining the ratio of low frequency energy to high frequency energy of the filtered spectrum to determine whether said at least one of said detector signals is indicative of a small flame flicker frequency.

14. A flame detector apparatus comprising:

a) a first infrared detector being responsive to radiation of a first infrared wavelength and generating a first analog electrical signal in response thereto;

b) an ultraviolet radiation detector being responsive to ultraviolet wavelength radiation and generating a second analog electrical signal in response thereto;

c) an A/D converter for periodically sampling said first and second analog electrical signals, and converting them to first and second digital sample values, respectively;

d) a digital signal processor for receiving said first and second digital sample values, and calculating the normalized cross-correlation of said first and second digital sample values to determine whether radiation detected by said first and second detectors is received directly from a flame or from a reflection of a flame, said digital signal processor including means for generating an alarm signal if the calculated normalized cross-correlation exceeds a threshold value which indicates that radiation detected by said first and second detectors is received directly from a flame; and e) alarm indicator means responsive to said alarm signal for indicating that a flame has been detected.

15. The flame detector apparatus of claim 14, wherein said digital signal processor is further programmed to calculate the frequency spectrum of at least one of said digital sample values, and determine from said frequency spectrum, whether radiation detected by said first and second detectors has a relatively high flicker frequency indicative of a small flame, or has a relatively low flicker frequency indicative of a large flame.

16. The flame detector of claim 14, further comprising:

f) a second infrared radiation detector responsive to radiation of a second infrared frequency and generating a third analog electrical signal in response thereto, said third analog electrical signal also being sampled and converted by said A/D converter;, to form a third digital sample value;

wherein, said digital signal processor is programmed to calculate the normalized cross-correlation of each pair of digital sample values, and generate an alarm signal if any of said normalized cross-correlations exceeds said threshold value.

17. A method for detecting a flame which discriminates between a directly detected flame, and the reflection of a flame, said method comprising:

a) selecting a plurality of radiation wavelengths which are all present in a flame to be detected, but which have different reflection characteristics;

b) providing a plurality of wavelength selective radiation detectors, each said detector being responsive to radiation of a corresponding one of said plurality of wavelengths, and generating an electrical signal in response thereto;

c) positioning said plurality of detectors to receive radiation from an area in which a flame is to be detected;

d) calculating the normalized cross-correlation of each pair of detector signals;

e) comparing the value of said calculated normalized cross-correlation of each pair of detector signals to a threshold value above which indicates that the radiation detected by said plurality of detectors is received directly from a flame, and not from a reflection of a flame; and f) generating an alarm indication if the normalized cross-correlation value of at least one pair of detector signals exceeds said threshold value.

18. The method of claim 17, wherein the steps of selecting, providing and positioning further comprise:

a) selecting first and second infrared radiation wavelengths and an ultraviolet radiation wavelength which are all present in a flame to be detected, but which have different reflection characteristics;

b) providing first, second and third wavelength selective radiation detectors, said first detector being responsive to radiation of said first infrared wavelength and generating a first electrical signal in response thereto, said second detector being responsive to radiation of said second infrared wavelength and generating a second electrical signal in response thereto, and said third detector being responsive to radiation of said ultraviolet wavelength and generating a third electrical signal in response thereto; and c) positioning said first, second and third detectors to receive radiation from an area in which a flame is to be detected.

19. The method of claim 17, wherein the step of generating an alarm indication further comprises:

1) calculating a frequency spectrum of at least one of said detector signals;

2) calculating the ratio of low frequency components to high frequency components in said frequency spectrum; and 3) generating an alarm signal only if the ratio of low frequency components to high frequency components is below a preset threshold ratio value which indicates that the flicker frequency of the detected radiation is characteristic of a small flame.

20. The method of claim 18, wherein the step of generating an alarm signal further comprises:

i) high pass filtering the frequency spectrum if the ratio of low frequency components to high frequency components is above said preset threshold ratio value to form a filtered frequency spectrum;

ii) calculating the ratio of low frequency components to high frequency components in said filtered frequency spectrum; and iii) generating an alarm signal if the ratio of low frequency components to high frequency components in said filtered frequency spectrum is below said preset threshold ratio value.

* * * * *